United States Patent [19]

Wagner

[11] Patent Number: 4,518,837

[45] Date of Patent: May 21, 1985

[54] ELECTRICAL SWITCH FOR INDUCTION HEATING SYSTEM

[75] Inventor: Thomas R. Wagner, New Hartford, N.Y.

[73] Assignee: United Technologies Corporation, Hartford, Conn.

[21] Appl. No.: 512,933

[22] Filed: Jul. 12, 1983

[51] Int. Cl.[3] ..... H01H 35/24; H01H 9/52

[52] U.S. Cl. ..... 200/81 R; 200/289

[58] Field of Search ..... 200/1 V, 16 B, 16 E, 200/81 R, 289

[56] References Cited

U.S. PATENT DOCUMENTS

| | | | |
|---|---|---|---|
| 1,612,318 | 12/1926 | Riley | 200/240 |
| 1,623,954 | 4/1927 | Ansingh | 200/248 |
| 1,920,713 | 8/1933 | Prince | 200/158 |
| 2,694,117 | 11/1954 | Bakke | 200/19 A |
| 3,244,833 | 4/1966 | Gillett et al. | 200/289 X |
| 3,263,145 | 7/1966 | Dexter | 318/266 |
| 3,700,840 | 10/1972 | Wilson et al. | 200/48 R |
| 3,703,621 | 11/1972 | Viola et al. | 200/16 E X |
| 3,778,680 | 12/1973 | Vaneerden | 317/100 |

FOREIGN PATENT DOCUMENTS

| | | | |
|---|---|---|---|
| 457591 | 8/1968 | Switzerland | 200/289 |
| 949807 | 2/1964 | United Kingdom | 200/289 |

*Primary Examiner*—J. R. Scott

*Attorney, Agent, or Firm*—C. G. Nessler

[57] ABSTRACT

A switch especially useful for interrupting high frequency induction heating currents is comprised of mating conical shaped contacts. The contact parts of the switch are water cooled by internal cooling channels which are not affected by making or breaking of the switch. The opposing contacts are mounted on separable pieces of the switch; when the clamp is released one side of the switch can be freely separated from the first part. Thus, inflexible high power electrical connections can be made and boken in a vacuum environment through physical movement of the coil and load.

11 Claims, 3 Drawing Figures

ELECTRICAL SWITCH FOR INDUCTION HEATING SYSTEM

TECHNICAL FIELD

The present invention relates to switch apparatus for making and breaking contact of electric current, particularly of high frequency currents used in induction heating.

BACKGROUND

The present invention is particularly useful for vacuum induction melting equipment wherein an induction coil surrounds a metal containing crucible mounted inside a vacuum chamber. Traditionally, power of about 3000 Hz or higher frequency is passed through the walls of the chamber by means of hollow copper tubes having cooling water running through their center.

The induction coil which surrounds the melting crucible or other apparatus is usually a helix of water cooled copper tubing. This coil is connected to the tubing coming through the furnace wall. Provision ordinarily must be made for motion of the crucible within the chamber, such as tilting or vertical motion, and for removal of the coil and its encaptured crucible from the furnace for maintenance or replacement. Thus, there must be a disconnect device capable of carrying high frequency electrical currents while avoiding water leaks. Most commonly, standard hydraulic hoses having stranded electrical wires in their interior are used as connectors. These tend to be large and bulky but have the advantage of being adaptable to misalignments and the like. When rigid connectors are used, with conventional pipe connecting fittings such as unions, leaks can occur unless alignment is correct. And such fittings are inherently incapable of allowing movement of the induction apparatus in the chamber when under a vacuum.

Of course, a great variety of switches and other disconnectable connections are known for use with high currents. But, few of these devices are constructed in such a manner as to be effective with high frequency induction currents (which induce heating of the parts) and also to be effective in a vacuum.

DISCLOSURE OF THE INVENTION

An object of the invention is to provide an improved means for connecting electrical apparatus within a vacuum chamber, most particularly for connecting the induction coil in a furnace to the termini of conductors passing through the side of the furnace. A further object is to provide a switch which permits free motion of the apparatus within the chamber with respect to the conductor termini.

According to the invention a switch has mating male and female contacts of cup and cone design. The contacts are mounted on opposing movable parts of the switch, to enable them to engage each other as a conductive contact set. Each contact has channels for the flow of coolant; the coolant flow path is independent of the electrical flow path so that when the electric current flow is interrupted the coolant flow is unaffected. The switch has electrically isolated means for clamping the two parts together to obtain intimate contact. The contacts are connectable to input and output conductors, to enable making and breaking the electrical flow path therebetween.

A preferred embodiment switch has two electrical poles and connects in a high frequency line of parallel copper tubing conductors, such as characterizes a simple induction heating apparatus. The contacts are fixed to insulating portions of the first and second parts. Cooling water flows to and from the contacts by means of a combination of the copper tubing and non-conducting hydraulic hoses. The means for clamping the parts together as a closed switch are two parallel hydraulic cylinders fixed to the first of the two switch parts. Each cylinder has an extending rod and a rotatable arm attached thereto which engages the second part and firmly presses it toward the first part upon actuation. When released, the clamp arms rotate so that the second switch part and the load or apparatus attached thereto can be physically removed from proximity of the first part. When the first part is cantilever supported by the power input lines or other means, elasticity in the supports enables good self-alignment of the switch parts due to the cup and cone shape of each contact set.

The switch configuration makes it adaptable to conduction of high currents of high frequency ($\sim$1000 Hz) alternating current, since the electrical isolation and cooling of the diverse parts avoids excessive heating and degradation of the components. The separation of the coolant channel flow from the electrical flow path enables the switch to be opened in a controlled environment such as a vacuum without degradation of the environment.

The foregoing and other objects, features and advantages of the present invention will become more apparent from the following description of preferred embodiments and accompanying drawings.

BEST MODE FOR CARRYING OUT THE INVENTION

The invention is described in terms of its use with a vacuum induction melting furnace wherein the induction coil and crucible contained therein are moved vertically subsequent to the metal contained in the crucible being melted. It will be evident that the invention is applicable to other uses, whenever a high frequency current is desired to be efficiently interrupted. By high frequency induction current is meant alternating current having a frequency of 1000 Hz or greater.

Figure 1:
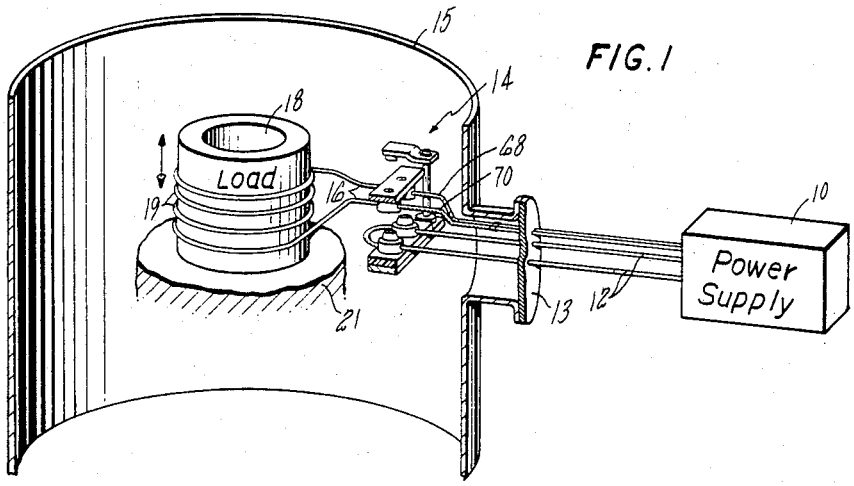
FIG. 1 shows schematically an induction heating power supply feeding an induction coil load inside a vacuum furnace chamber by means of a switch of the present invention within the chamber.

A representative arrangement where the invention is useful is shown in FIG. 1. A power supply 10, such as a motor-generator set, outputs high frequency current through water cooled copper conductors 12. The conductors 12 pass through a nonconductive flange 13 set in the wall of the chamber 15 and terminate at a switch 14 of the present invention. Power passes through the switch to another set of conductors 16, and then to the load 18. Typically the load is a ceramic crucible surrounded by a straight cylindrical helical coil 19 made of copper tubing.

Figure 3:
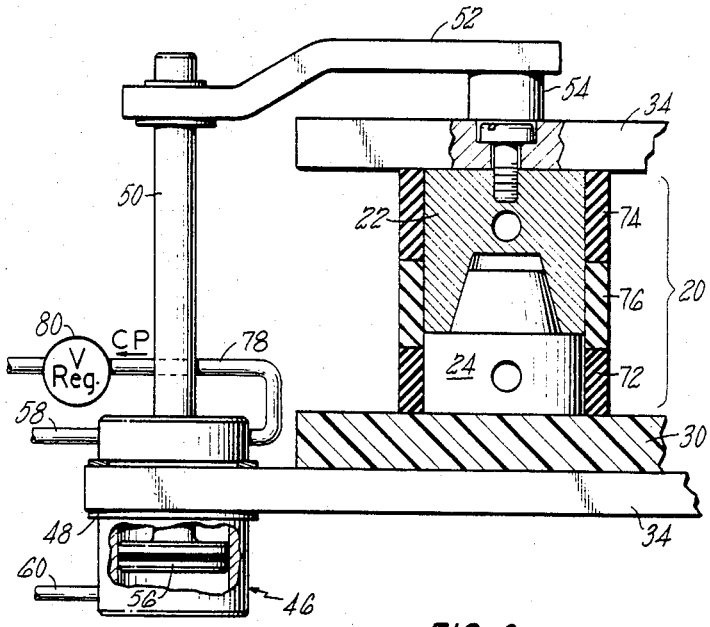
FIG. 3 is a sectional view through a portion of the apparatus shown in FIG. 2.
Figure 2:
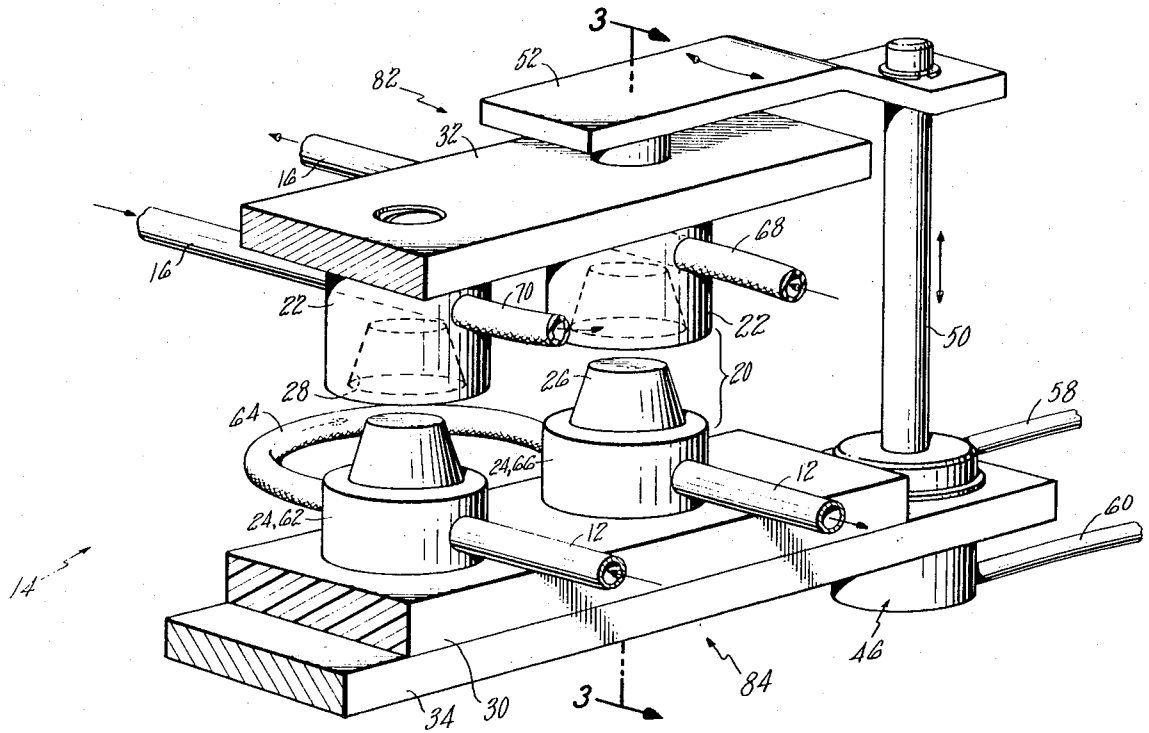
FIG. 2 is a perspective view of a two pole switch of the invention, with the clamp nearest the viewer omitted.

More detailed views of the elements of the invention are shown in FIGS. 2 and 3. FIG. 2 shows the major portion of the apparatus while FIG. 3 is a partial cross section of one of the two conical shaped contacts 20. The Figures show a two pole switch although it will be evident that additional poles may be included in other embodiments. Each pole is comprised of a set 20 of copper contacts, an upper female contact 22 and a lower male contact 24. The contact 24 has a cylindrical base portion and a conical shaped upper portion 26. The tapered conical portion 26 is received by a mating conical hollow section 28 in the female contact. The contacts 24, 22 are bolted respectively to lower and upper insulator plates 30, 32. These plates are made of a rigid insulator, such as fabric reinforced phenolic plastic. The lower insulator plate 30 is mounted on a rigid aluminum base plate 34. The upper insulator plate 32 and its attached contacts 22 is adapted to move vertically upward away from the base plate and its attached contacts 24 when there is no restraint, as described below.

Power input pipes 12 connect to the lower set of contacts 24. Analogous water cooled copper pipes 16 electrically and hydraulically connect the upper contacts 22 to the induction coil load 18. The support of parts of the apparatus in space is best obtained by cantilevering them off the pipes 12 and 16. That is, the pipes 12 are connected fixedly to the walls of the chamber and the pipes 16 are connected fixedly to the load coil (which is independently supported on a movable base plate 21). Thus, both main parts of the switch are cantilevered from structures. There is an advantage in this in that the elasticity of the supporting pipes gives a certain compliance to the upper and lower parts of the switch 14 when they are mated, thus permitting less than perfect vertical alignment. Nonetheless, it will be evident that in other embodiments, the upper and lower assemblies of the switch may be supported independently or off each other in different mechanical configurations. This will be done when the pipes are replaced with other conductors which are not suited to support the parts of the assembly.

The upper part 82 of the switch can be moved upward by motion of the pipes 16 to which it is connected. It can be entirely removed from proximity of the lower portion of the switch, thus permitting movement of the load within the chamber. When the upper part 82 is brought again into proximity of the lower part 84 of the switch to make electrical contact, the upper part is lowered vertically until the female portion of the conical contacts 22 encapsulates the male contacts 24. Then the apparatus is clamped together by means of the clamping mechanism.

The clamping mechanism is comprised of two identical sub-assemblies on either end of the base plate 34. Each hydraulic cylinder 46 is mounted in the base plate 34, preferably with a surrounding insulator 48 which electrically isolates it from the base plate, to avoid induced circulating currents. At the end of the piston rod 50 is a clamp arm 52 which is fixed to the shaft axially but is free to rotate about the longitudinal axis of the piston rod 50. The arm bears on an insulating spacer 54 to enable the load of the clamp to be concentrated over the center line of the contact set 20. When the piston 56 of the hydraulic cylinder is moved vertically downward by means of hydraulic pressure entering the line 58, the clamp 52 forces the contact set 20 together with great force. When the hydraulic fluid is applied to the opposing side of the piston 56, the rod 50 rises, releasing the pressure on the arm 52. At this point the arm 52 may be rotated about the shaft 50, to permit the free vertical motion of the upper part 82.

The pipes 12, 16 are hollow copper tubes and water flows through them as indicated by the arrows in FIG. 2. Water flowing through inlet line 12 to the contact 24, 62 is carried through a non-conductive rubber hose 64 to the second pole contact 24, 66 and returns through the outlet line 12. In analogous fashion, the water flow to the upper contacts 22 enters and leaves by means of the nonconductive hoses 68, 70 after it flows through the induction coil by means of the hollow copper lines 16. Thus, the water does not follow the same path as the electricity in the switch. And when the upper and lower parts of the switch are electrically separated water continues to flow through the coil, as is usually desired because of residual heat in the load. Other hose connections may be used, and the same water which flows through the pipes 12 may be made to flow through the pipes 16 by connections which will be evident.

In the best mode of the invention, a conical angle of the mating contacts should be between 25°–35°, preferably about 30°. If the angle is too steep, then a wedging will result and it will be difficult to separate the contacts; if the angle is too oblique, then sufficient interface force will not be generated to get a good electrical connection and arcing will result. The foregoing angles are only suggested and other angles may be found useful in experiment, depending on the current the switch must carry.

Generally, the pipes 12, 16 are insulated to prevent arcing. In like manner, the contacts of the switch are insulated as shown in FIG. 3. (The insulation is removed for clarity in FIG. 2.) The contacts are preferably cylindrical since this reduces corona discharge and it is easier to fabricate the insulation pieces 72, 74, 76 into rings. Preferably the sleeve 76 is rubber and is easily removed.

Extraneous induction heating fields emanating from the switch to the surroundings may be protected against by encapsulating the switch in metal shielding, as allowed by the necessary motion of the switch parts during use. There can be eddy currents induced in the clamping apparatus. Therefore, the arm 52 and the piston rod 50 are preferably a less magnetic material such as AISI 304 stainless steel. There can be excessive heating of the metal cylinder 46, and in the best mode of the invention an additional line 78 is provided on the side of the cylinder which is pressurized when clamping action is being applied, namely the side provided with the line 58 in the FIG. 3. The line 78 is connected to a pressure relief valve 80 and this valve is set at a pressure sufficiently high to provide the necessary force on the piston rod, but which pressure is less than the peak pressure provided by the hydraulic power supply to the line 58. Thus, there will be a continuous flow of hydraulic oil through the lines 58, 78 when the clamp 46 is actuated. This continuous flow of oil will maintain the piston at a temperature within its operating range.

In general, the switch of the invention will be useful in single and multi-pole configurations. The current carrying capacity of the switch will be determined by the number and size of the contacts, and the conical area of contact at a set will be varied accordingly. For carrying 3000 Hz current in excess of 100 amperes, a 30° conical contact set will be made of good conductivity grade of copper such as ETP copper and will have an apparent conical area of contact of about 10 $cm^2$.

While the preferred embodiment of the invention is described as having water channels running through the contacts, it will be appreciated that other coolants, including gases, may be used. Also, the channels may be of a different configuration, comprising such as small tubes running around the periphery of the contacts. Similarly, while the preferred embodiment shows the switch connected to hollow pipes which carry both water and electricity, it is within contemplation that the switch may be used where the electrical conductors are of sufficient size with respect to the current being carried that they are not cooled. In such instances, the switch coolant would be delivered directly to the contacts by separate non-conductive lines.

As pointed out, the cup and cone design of the contacts is a shape particularly suited for the invention since they have good capacity to cause alignment and provide good surface intimacy. However, this design does not exclude the use of additional guides which will assist in bringing the contact sets into initial proximity. Furthermore, while a cone is the most easily generated surface of revolution which carries out the objects of the invention, the word "conical" herein is used in a loosely generic sense and other self-aligning tapered sections will be equally useful and are within the scope of the invention.

Although this invention has been shown and described with respect to a preferred embodiment, it will be understood by those skilled in the art that various changes in form and detail thereof may be made without departing from the spirit and scope of the claimed invention.

I claim:

1. A switch for controlling the flow of electrical current comprised of a first part having mounted thereon a contact having a conical shaped male section;

a second part movable with respect to the first part, having mounted thereon a contact having a conical shaped female section adapted to intimately receive the male contact section, the parts shaped so that movement of the second part toward the first part enables conical mating of the female contact with the male contact to form a contact set which allows the flow of electrical current therethrough;

both said contacts having channels which provide for coolant flow through the set along a path different from that of the electric current flow, said coolant flow path being maintained during times when said parts of the switch are moved apart; and means for clamping which when actuated force the first part against the second part and which when released permit separation of the parts and subsequent free relative movement of the parts in any direction.

2. The switch of claim 1 comprised of a plurality of male and female contacts and contact sets.

3. The switch of claim 1 characterized by clamping means comprised of a hydraulic cylinder and means for continuing the flow of the actuating hydraulic fluid through the portion of the cylinder which is pressurized, when the switch parts are clamped together.

4. The switch of claim 3 characterized by a pressure relief valve connected to the cylinder to enable the continuing of hydraulic fluid flow.

5. The switch of claim 1 wherein one of the parts is mounted on an elastically deformable cantilever support.

6. The switch of claim 5 wherein the cantilever support is a hollow copper tube connected to a contact, the tube adapted to carry coolant and electric current to the contact.

7. The switch of claim 1 wherein the included angle of the conical section is 25°–35°.

8. The switch of claim 1 characterized by the first part having a base, a plurality of contacts attached thereto insulated to isolate them from the base plate and each other; a second part having a plurality of contacts attached thereto insulated to isolate them from each other and other parts of the apparatus; a means for clamping comprised of a hydraulic cylinder attached to the base plate, the cylinder having an actuator rod with a clamp arm attached thereto, the clamp arm forcing the second part toward the first part when the cylinder is actuated and capable of being rotated when the cylinder is not actuated, to enable the separation and free relative movement of the parts.

9. The switch of claim 8 wherein the male and female contacts are interchanged.

10. The switch of claim 8 wherein insulation entirely circumscribes the contact sets when the contacts are mated.

11. The switch of claim 8 wherein the clamp arm is rotatable about the rod.

* * * * *